United States Patent [19]

Thompson

[11] Patent Number: 4,489,454

[45] Date of Patent: Dec. 25, 1984

[54] PORTABLE HINGED TRANSDUCER CARRIER

[76] Inventor: James C. Thompson, 2671 Erlene Dr., Apt. 1704, Cincinnati, Ohio 45238

[21] Appl. No.: 394,776

[22] Filed: Jul. 2, 1982

Related U.S. Application Data

[63] Continuation-in-part of Ser. No. 116,553, Jan. 29, 1980, abandoned.

[51] Int. Cl.[3] ..... A61G 7/06

[52] U.S. Cl. ..... 5/503; 248/289.1; 5/508

[58] Field of Search ..... 5/503, 508; 128/674; 248/282, 278, 289.1

[56] References Cited

U.S. PATENT DOCUMENTS

| | | | |
|---|---|---|---|
| 1,218,923 | 3/1917 | Bogdanski | 248/278 |
| 1,224,617 | 5/1917 | Easton | 5/503 |
| 1,231,452 | 6/1917 | Sword | 5/503 |
| 2,104,524 | 1/1938 | Porter | 248/278 |
| 2,375,565 | 5/1945 | Liakopulos | 248/282 |
| 2,605,069 | 7/1952 | Gillaspy | 248/103 |
| 2,651,725 | 9/1953 | McFarland | 248/282 |
| 3,124,133 | 3/1964 | Marbach | 128/674 |
| 3,561,431 | 2/1971 | Pannier | 128/674 |
| 3,971,538 | 9/1975 | Marvich | 248/278 |

*Primary Examiner*—Alexander Grosz
*Attorney, Agent, or Firm*—Keil & Weinkauf

[57] ABSTRACT

An apparatus, for carrying a hemodynamic pressure transducer in a hospital bed so that the transducer is maintained in a constant relationship with the level of the heart of a patient in said bed, is taught, which comprises a first, vertical member for mounting said apparatus on said hospital bed, where said first vertical member is adapted to fit into a bracket provided on a hospital bed, and is further adapted to hold an intravenous feeding pole, so that said apparatus may hold an intravenous feeding pole as well as said hemodynamic pressure transducer; hinge means attached to and projecting horizontally from said first vertical member; a second member engaging said hinge means and disposed to project in a direction perpendicular to the axis of said first member; and a third, vertical member to which said transducer is adjustably but securely affixed. The bracket may be an intravenous feeding pole bracket provided on said bed. The first member may be mounted on a portion of said bed which is so selected that the relationship between the height of the transducer and the height of the patient's heart remains constant when the level of the bed is raised or lowered.

3 Claims, 2 Drawing Figures

PORTABLE HINGED TRANSDUCER CARRIER

REFERENCE TO RELATED APPLICATIONS

This application is a continuation-in-part of my copending application Ser. No. 116,553, filed Jan. 29, 1980, entitled "PORTABLE HINGED TRANSDUCER CARRIER," now abandoned.

FIELD OF THE INVENTION

My invention pertains generally to devices for use in hospitals which provide means for carrying pressure transducers used in hemodynamic pressure monitoring in hospitals. The apparatus is especially adapted to be mounted directly to the patient's bed and acts to maintain the pressure transducer at the same level as the patient's heart.

BACKGROUND OF THE INVENTION

The monitoring of hemodynamic pressure using pressure transducers is a task which must be accurately performed in hospital settings, such as intensive care units and recovery rooms, wherein critical situations are often encountered. Accurate readings from transducers can be obtained only with the patient in the supine position horizontal to the floor. The pressure transducer must at all times be positioned at the same level as the patient's heart for accurate readings.

In the past, transducers have been mounted independently of the patient and the bed by attaching them to a conventional portable intravenous feeding pole (hereinafter, IV pole), for example. This technique requires repositioning the level of the transducers if the bed height is changed. However, changes in bed height are frequently required during critical situations. Furthermore, the use of separate poles for transducer mounting takes up floor space around the bed which interferes with nursing care and transportation of the patient. Patients with pressure monitoring often must be transferred from room to room, particularly to the operating room, many times in emergency situations. Where speed is necessary, obstructions in the working area around the patient cannot be tolerated.

Transducers have also been mounted directly to the patient by attaching the transducer to the patient's arm. This requires tight bandages which may impede circulation, while failing to insure a constant positioning of the transducer at the level of the heart.

Transducers must be vertically adjustable so as to make possible adjustment of the height of a transducer relative to the height of a patient's heart. Accordingly, means are provided to adjust the height of the transducer by releasing the attachment between the transducer and the present invention, adjusting the height of the transducer, and securely attaching the transducer at its desired height.

SUMMARY OF THE INVENTION

My invention provides a simple device upon which transducers used in hemodynamic pressure measurement can be quickly and easily mounted and then used by a nurse or trained anesthesia technician without the need for the constant supervision of a doctor. The primary purpose of this apparatus which I have invented is to provide consistent, accurate monitoring of the body pressures of a critically ill patient while at the same time providing the mobility required in an intensive care unit.

The apparatus I have invented is designed to be inserted into the IV pole bracket of the conventional intensive care bed. Thus, the apparatus according to my invention requires no special additions to existing hospital equipment. Without the device I have invented, however, it is not possible to mount transducers to the IV pole which is ordinarily attached to the bed because of the position that the pole takes above the level of the patient and because the transducer mounted on a bed-mounted IV pole will interfere with the function of the bed.

The device I have invented generally comprises a first vertical rod member adapted to be inserted in the IV pole bracket on the hospital bed. Attached to this first member, and projecting in a direction perpendicular to the axis of this first member are mounted one or more means for hinging a second horizontal member that may be swung or rotated about the first member. At the end of the second member distal from the first member is provided a hole or other attachment means for a third, vertical rod member upon which the transducers may be attached. This third vertical member may be provided with means to raise and lower it through the attachment means on the second horizontal member and may also be provided with a stop to prevent the third member from being dislodged from the second member.

In use, the transducer is releasably, but securely, attached to the third vertical rod member so that the height of the transducer relative to the patient's heart may be adjusted and the transducer then securely attached to the third vertical rod member.

While the apparatus I have invented is simple, it provides a number of features which are not achieved by any other prior art devices. As a first feature, my invention provides a device for mounting transducers to a hospital bed which is both fast and easy, requiring no special technical ability.

As a second feature, my invention provides an additional capability to hospital equipment without compromising the present features of that equipment.

In particular, the first vertical rod member is adapted to be inserted into an IV pole bracket at its lower end and is adapted to be hollow at its upper end so that the IV pole may be inserted into the upper end. Thus, my invention may be mounted in an IV pole socket without displacing the IV pole, because my invention provides a convenient socket for the IV pole.

As a third and most important feature, my invention provides consistent accurate hemodynamic pressure readings during crisis situations by providing a means to adjust rapidly without the need for cumbersome equipment the height of transducers relative to the heart of the patient. As a part of this feature, the device according to my invention insures that the level of the transducer may be maintained at the level of the right atrium of the heart consistently regardless of whether the bed, and the patient on it, have been raised or lowered. For example, during a crisis situation, the level of the entire bed is often lowered when the patient must be resuscitated. As the patient is being lowered, the transducer level will remain constant in relation to the level of the right atrium of the heart.

Yet another feature of my invention is a device that permits patient transfers from bed to bed to be made easily without altering the level of the pressure transducer. All that needs to be done when a patient is transported is to disconnect the transducer cables from the monitor or roll the monitor out of the way behind the bed as the bed is rolled through the hospital doors. If the monitor is taken along with the bed, of course, readings can be made from any electrical outlet available en route. If the transducer cables are disconnected, all that need to be done when the patient arrives at his or her destination is to reconnect the cables to a suitable monitor and the readings obtained will be directly comparable with the readings obtained prior to the transfer.

Still another feature of the device I have invented is the reduction of the chance of obtaining inaccurate readings due to undetected changes in the level of the transducer. Obviously, this reduces the chance of mistake in medical decisions, which may result in prolonged unnecessary hospitalization and increased cost.

The simplicity of the device according to my invention provides the further feature of better utilizing nurses' time by reducing the number of non-nursing tasks that they are called upon to perform.

Many other features and advantages of my invention will be apparent to a person skilled in this art from reading the disclosure herein. I wish to point out finally that the apparatus according to my invention is easily stored in hospital locations that will insure its easy access when needed.

DETAILED DESCRIPTION OF THE PREFERRED EMBODIMENT

Figure 1:
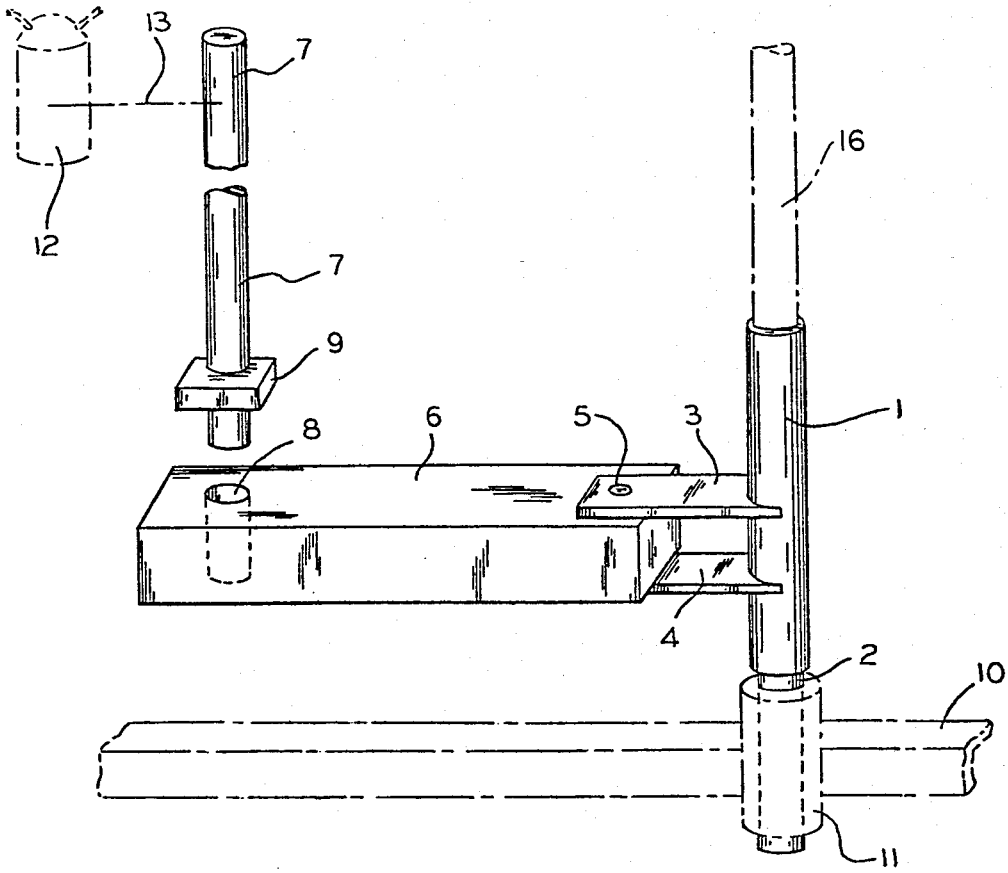
FIG. 1 is a perspective view of an embodiment of my invention. This drawing is not intended to be in scale.
Figure 2:
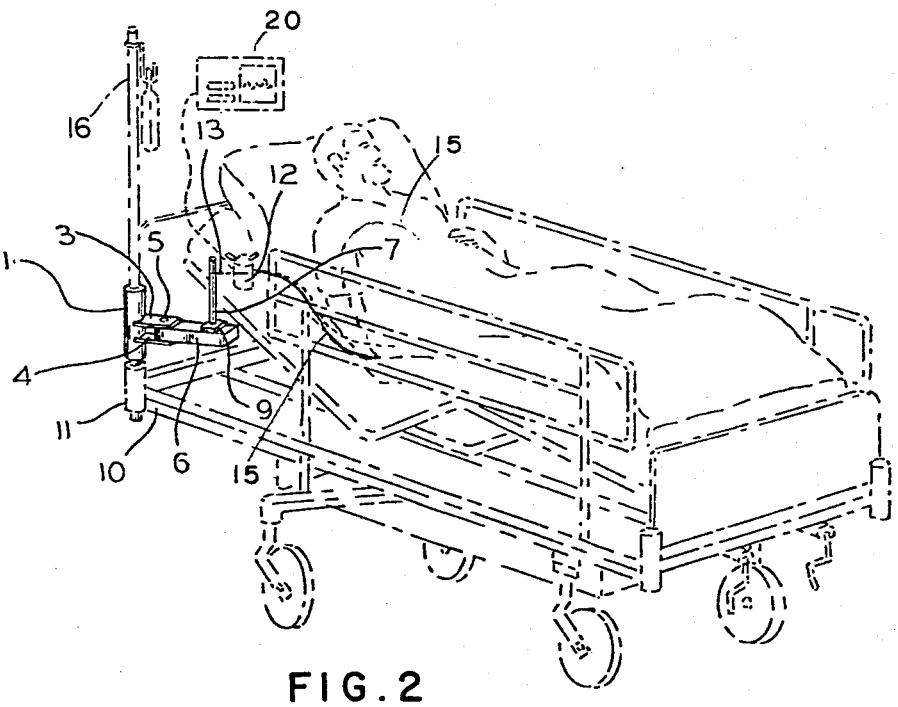
FIG. 2 is a perspective view of my invention shown in use on a hospital bed.

The apparatus according to my invention is mounted to the hospital bed, so that it is out of the working field used by the nurse but so that it may be swung into the working field when needed. The first vertical rod member 1 is equipped with a reduced diameter portion 2 which is adapted to fit into the IV bracket 11 on a hospital bed and is also adapted to hold IV pole 16 in an upper opening therein. Instead of using this peg 2, the vertical rod 1 may be attached to the bed by means of a separate bracket, which is not depicted. Such a bracket may be in the form of a hose clamp attached to an angle iron or equivalent means. Two sturdy metal straps 3 and 4 are firmly welded to vertical rod 1 to provide one part of the hinge assembly of the device. Holes are drilled to each of members 3 and 4, through which a hinge pin 5 may be inserted. An elongated horizontal member 6, which may be made out of bar stock or square tubing, is drilled at one end to accommodate hinge pin 5 and at the other end to accommodate vertical third member 7, which is shown in partially cut-away form. Vertical member 7 is mounted into horizontal bar 6 by sliding it into hole 8 drilled into the end of bar 6 which is distal from vertical rod 1. Vertical member 7 is provided with a permanently affixed stop 9 which prevents rod 7 from sliding into hole 8. Vertical rod 7 is removable for storage and during transportation of the device. The transducer is releasably, but rigidly, mounted on vertical bar 7 at the desired elevation. The carrier depicted in FIG. 1 may be swung about hinge pin 5 to position the transducers mounted on vertical member 7 at any desired position. The horizontal bar 6 may be swung out of the way next to the bed for easy carriage as well as swung in any desired direction. Clamping means 13, shown by a broken line, supports pressure transducer 12. Referring to FIG. 2, tubing 15 enters the patient's circulatory system for the purpose of blood pressure measurements. Electronic monitor 20 records the blood pressure measurements, and may be connected to a central computer (not shown) for patient monitoring purposes.

This application sets forth detailed description of a preferred embodiment of my invention in accordance with the requirements of the Patent Act. Based on the disclosure herein, however, persons skilled in this art will be able to devise modifications of my device, either in dimensions, in location on the bed, or in mechanical connections, which do not depart from the scope and spirit of my invention. I intend by the following claims to cover not only the depicted embodiments but also all other embodiments which are within the scope and spirit of the invention I have disclosed.

What I claim is:

1. Apparatus for carrying a hemodynamic pressure transducer in a hospital bed so that the transducer is maintained in a constant relationship with the level of the heart of a patient in said bed, comprising:

(a) a first, vertical member for mounting said apparatus into a bracket provided on a hospital bed, said member being adapted to hold an intravenous feeding pole in an opening in its upper end;

(b) hinge means attached to and projecting horizontally from said first vertical member;

(c) a second member engaging said hinge means and disposed to project in a direction perpendicular to the axis of said first member; and (d) a third, vertical member to which a hemodynamic pressure transducer may be affixed.

2. The apparatus of claim 1, wherein, said first member is mounted on a bracket of a hospital bed which is so selected that the relationship between the height of the transducer and the height of the patient's heart remains constant when the level of the bed is raised or lowered.

3. Apparatus for carrying an electromechanical hemodynamic pressure transducer to be mounted on a hospital bed without reducing the capacity of the bed for mounting other apparatus, wherein the transducer is maintained at a constant vertical relationship with the level of the heart of a patient on said bed, even when said transducer is moved horizontally away to allow unobstructed access to the patient or when the bed is being moved, thereby allowing continuous hemodynamic pressure monitoring even during emergencies, which comprises:

(a) a first member to be mounted essentially vertically at its lower end into an intravenous feeding pole socket in a hospital bed and adapted at its upper end to accept a bottom of a hospital intravenous feeding pole for the purpose of holding said pole in a fixed relationship to the hospital bed during intravenous feeding procedures;

(b) a second member attached rigidly at a first end to said first member, and having a hinged mounting in a second end;

(c) a third member mounted essentially horizontally and attached rotatably at a first end to said second member and said hinged mounting, and with means for mounting a vertical member at a second end;

(d) a fourth member mounted essentially vertically at said second end of said third member; and (e) an electromechanical hemodynamic pressure transducer securely mounted on said fourth member by a mounting means, said mounting means being vertically adjustable to allow the maintenance of a constant vertical relationship between said transducer and the patient's heart, Whereby said first member attaches said apparatus to a hospital bed by being inserted into an intravenous feeding pole socket, and further provides a socket for holding an intravenous feeding pole, and said horizontal second and third members are hinged in the horizontal plane to provide horizontal adjustment in the location of said electromechanical pressure transducer, and said fourth member is a vertical support which provides an adjustable height mounting position for said electromechanical hemodynamic pressure transducer for the purpose of maintaining a desired height of the transducer relative to the height of a patient's heart.

* * * * *

UNITED STATES PATENT AND TRADEMARK OFFICE

CERTIFICATE OF CORRECTION

PATENT NO. : 4,489,454

DATED : Dec. 25, 1984

INVENTOR(S) : James C. THOMPSON

It is certified that error appears in the above-identified patent and that said Letters Patent are hereby corrected as shown below: On the title page;

[76] "2671 Erlene Dr., Apt. 1704, Cincinnati, Ohio 45238"

should be

-- 2738 Main Chase, Crestview Hills, Kentucky 41017 -- .

Signed and Sealed this

*Thirtieth* Day of *July 1985*

[SEAL]

*Attest:*

DONALD J. QUIGG

*Attesting Officer* *Acting Commissioner of Patents and Trademarks*